US009546502B2

(12) United States Patent
Lange et al.

(10) Patent No.: US 9,546,502 B2
(45) Date of Patent: Jan. 17, 2017

(54) DOOR LOCK SWITCH WITH LOCK STATE INDICATOR

(71) Applicant: GM GLOBAL TECHNOLOGY OPERATIONS LLC, Detroit, MI (US)

(72) Inventors: Richard J. Lange, Troy, MI (US); Jeffrey L. Konchan, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 470 days.

(21) Appl. No.: 14/133,760

(22) Filed: Dec. 19, 2013

(65) Prior Publication Data

US 2015/0176309 A1 Jun. 25, 2015

(51) Int. Cl.

| | |
|---|---|
| ***E05B 41/00*** | (2006.01) |
| ***E05B 85/00*** | (2014.01) |
| ***E05B 85/08*** | (2014.01) |
| ***E05B 17/10*** | (2006.01) |

(52) U.S. Cl.

CPC ..... *E05B 41/00* (2013.01); *E05B 17/10* (2013.01); *E05B 85/00* (2013.01); *E05B 85/08* (2013.01); *Y10T 292/1043* (2015.04)

(58) Field of Classification Search

CPC ..... E05B 41/00; E05B 85/08; E05B 17/10; E05B 85/00; Y10T 292/1043

USPC ..... 296/146.1, 146.4

See application file for complete search history.

(56) References Cited

U.S. PATENT DOCUMENTS 3,943,352 A * 3/1976 Pena May ..... B60Q 9/001 200/314
4,647,087 A * 3/1987 Eisele ..... E05B 77/50 292/45
6,729,745 B2 * 5/2004 Yang ..... B60Q 1/2657 362/203
7,055,997 B2 * 6/2006 Baek ..... B60Q 3/0233 362/100
2003/0141986 A1 * 7/2003 Flick ..... B60R 16/03 340/12.53
2007/0200668 A1 * 8/2007 Kurpinski ..... B60R 25/2009 340/5.64

(Continued)

FOREIGN PATENT DOCUMENTS

CN 101006236 A 7/2007
CN 102852407 A 1/2013

*Primary Examiner* — Jason S Morrow
*Assistant Examiner* — E Turner Hicks
(74) *Attorney, Agent, or Firm* — Quinn Law Group, PLLC

(57) ABSTRACT

A door for a vehicle having a body controller includes a vehicle interior-facing surface. The door locking system includes a latch mechanism configured to alternately attain a first state that locks and a second state that unlocks operation of the latch mechanism. The door locking system also includes a control switch on the interior-facing surface for generating a signal to alternatively select one of the first and second latch mechanism states. The door locking system additionally includes an indicator light integrally mounted on the control switch and configured to provide a visual signal indicative of the selected latch mechanism state. The controller is configured to receive the signal from the control switch, command the latch mechanism to attain one of the first and second states in response to the signal, and trigger the indicator light when the latch mechanism has attained one of the first and second states.

20 Claims, 3 Drawing Sheets

(56) References Cited

U.S. PATENT DOCUMENTS

| | | | | |
|---|---|---|---|---|
| 2009/0153296 | A1* | 6/2009 | LeGasse | B60R 25/246 340/5.72 |
| 2009/0240383 | A1* | 9/2009 | Hung | H04L 12/66 701/1 |
| 2010/0011821 | A1* | 1/2010 | Kim | E05B 41/00 70/264 |
| 2012/0235568 | A1* | 9/2012 | Prodin | B60Q 3/0293 315/77 |
| 2013/0099524 | A1* | 4/2013 | Brown | B60J 5/0473 296/146.9 |
| 2013/0207773 | A1* | 8/2013 | Hathaway | B60K 28/12 340/3.43 |

* cited by examiner

DOOR LOCK SWITCH WITH LOCK STATE INDICATOR

TECHNICAL FIELD

The disclosure relates to access doors, and, in particular, to a door lock switch with a lock state indicator.

BACKGROUND

In general, doors are used to control passage between separate spaces. A typical door is a panel that swings on hinges, slides, or rotates inside a space. When open, doors admit ventilation and light. A door may be used to control physical atmosphere within a space so that an interior may be more effectively heated or cooled. Doors also act as a barrier to noise, inclement weather, and physical intrusion into a specifically defined space.

A typical vehicle has at least one door for accessing an interior of the vehicle. Such a door usually has a latch mechanism for maintaining the door in a locked state until access into or egress from the vehicle is required. Conventionally, the latch mechanism is actuated by an outside door handle to gain access to the interior of the vehicle, and by an interior door handle to facilitate exit from same. Actuation of the latch mechanism may also be locked or disabled to thereby prevent unauthorized access into the vehicle.

SUMMARY

A door for a vehicle having a vehicle body and a vehicle body controller includes a vehicle interior-facing surface. The door locking system includes a latch mechanism for selectively latching the door to and unlatching the door from the vehicle body. The latch mechanism is configured to attain, in the alternative, a first state and a second state, wherein the first state locks and the second state unlocks operation of the latch mechanism. The door locking system also includes a control switch arranged on the interior-facing surface and configured to generate a signal for alternate selection of the first and second states of the latch mechanism. The door locking system additionally includes an indicator light integrally mounted on the control switch and configured to provide a visual signal indicative of at least one of the first and second states of the latch mechanism. The latch mechanism and the control switch are in operative communication with the controller. The controller is configured to receive the signal from the control switch, command the latch mechanism to attain one of the first and second states in response to the signal, and trigger the indicator light when the latch mechanism has attained one of the first and second states.

The door may include a window and the vehicle interior-facing surface may include a window sill arranged proximate to the window. In such a case, the control switch may be positioned on the window sill.

The control switch may be configured as a maintained contact switch.

The control switch may also be a lock knob that is configured to be selectively pulled and pushed to alternatively select the first and the second states of the latch mechanism.

The indicator light may be configured as a light emitting diode (LED).

The LED may be configured to emit light having a first color when the latch mechanism is in the first state and light having a second color when the latch mechanism is in the second state.

The vehicle may have a plurality of such doors. In such a case, the controller may include an algorithm, the execution of which enables the controller to regulate selection of the first and the second states of each latch mechanism on the respective door in response to the signal from the respective control switch.

The controller may execute a first mode of operation for the door locking system that regulates the latch mechanism of each door to attain one of the first and second states in response to the signal from the respective control switch. In the first mode the controller may also trigger each respective indicator light when the corresponding latch mechanism has attained one of the first and second states.

The controller may also execute a second mode of operation for the door locking system that regulates the latch mechanism of each door to attain one of the first and second states in response to the signal from one of the control switches. In the second mode the controller may also trigger each respective indicator light when the corresponding latch mechanism has attained one of the first and second states.

The controller may include an interface portal configured to provide access to the user for selecting one of the first and second modes.

The vehicle may include a key-on mode and a key-off mode. In such a case, the controller may execute a third mode of operation for the door locking system that regulates the latch mechanism of each door to attain the first state in response to the vehicle being in the key-on mode and exceeding a predetermined vehicle speed and regulates the latch mechanism of each door to attain the second state in response to the vehicle being in the key-off mode. The interface portal may also be configured to provide access to the user for selecting the third mode.

Additionally, the interface portal may be configured to permit the user to select a color of light emitted by the LED.

The above features and advantages, and other features and advantages of the present disclosure, will be readily apparent from the following detailed description of the embodiment(s) and best mode(s) for carrying out the described invention when taken in connection with the accompanying drawings and appended claims.

DETAILED DESCRIPTION

Figure 1:
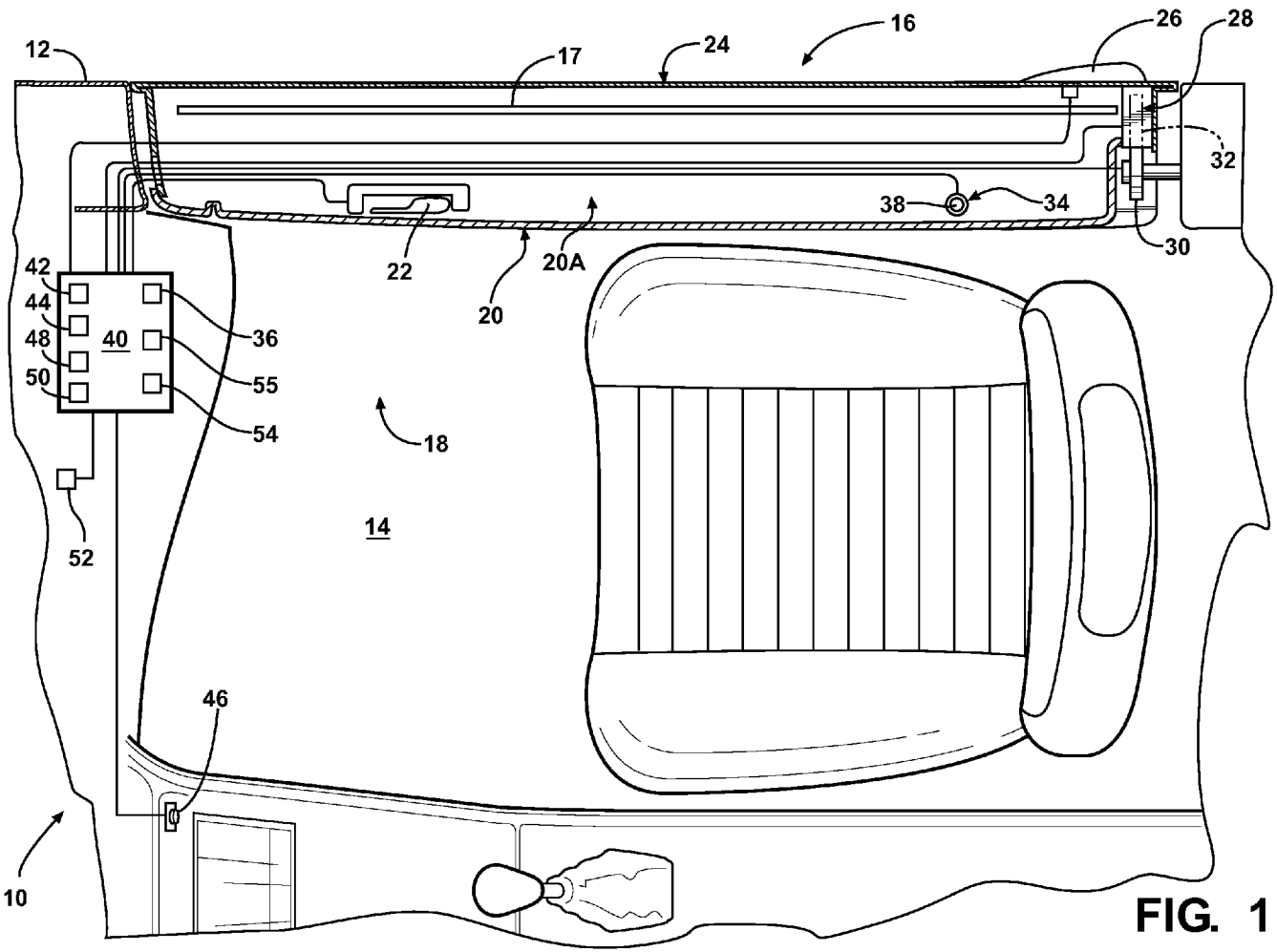
FIG. 1 is a schematic sectional partial top view of a vehicle illustrating a vehicle interior, one of the vehicle doors, and a door locking system.

Referring to the drawings, wherein like reference numbers refer to like components, FIG. 1 shows a vehicle 10 having a vehicle body 12 defining a vehicle interior 14. The vehicle 10 also includes a plurality of doors 16. Although only a single representative door 16 is shown in FIG. 1, it is to be understood that the vehicle 10 may have as many doors 16 as dictated by the specific vehicle design. Each door 16 is configured to selectively open and close an entryway into the vehicle interior 14. Although the representative door 16 is shown in FIG. 1 as a vehicle side door, the door 16 may also be configured as a tailgate (not shown, but known to those skilled in the art) or other type of a door for access into the vehicle 10. Each door 16 may also include a window 17.

Figure 2:
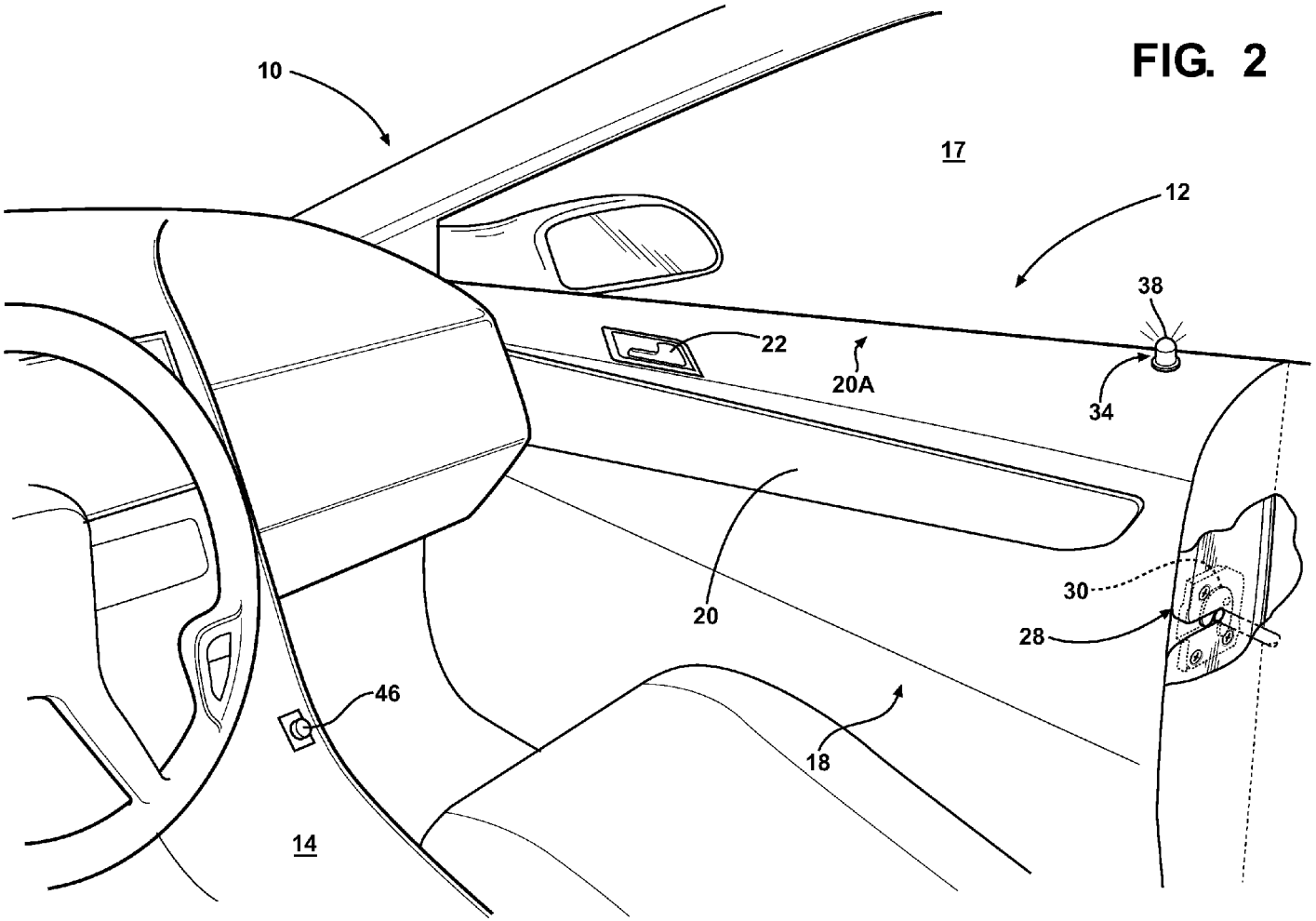
FIG. 2 is a schematic partial perspective view of a vehicle interior illustrating the door shown in FIG. 1, wherein the door is in a locked state.

The vehicle 10 also includes a door locking system 18. The door locking system 18 is configured to selectively lock and unlock the doors 16, and signal to a user or operator of the vehicle 10 whether each door is locked or unlocked. As shown in FIG. 2, each door 16 includes a vehicle interior-facing surface 20. An interior door-release handle 22 is positioned on the interior-facing surface 20. Each door 16 also includes an exterior-facing surface 24. An exterior door-release handle 26 is positioned on the exterior-facing surface 24. Each interior door-release handle 22 and exterior door-release handle 26 is configured to release and open the respective door 16. The door locking system 18 includes at least one latch mechanism 28. As shown, each door 16 includes the latch mechanism 28 for selectively latching the respective door 16 to and unlatching the subject door from the vehicle body 12.

The latch mechanism 28 is configured to be released via the interior door-release handle 22, as well as via the exterior door-release handle 26 to unlatch the respective door 16 and permit access into the vehicle interior 14. Each latch mechanism 28 is also configured to attain or achieve, in the alternative, a first state 30 (shown in FIG. 2) and a second state 32 (shown in FIG. 2), wherein the first state locks and the second state unlocks operation of the subject latch mechanism. Accordingly, the first state 30 of the latch mechanism 28 prevents unauthorized entry into or exit from the vehicle 10, such as in the case of child safety locks by disabling operation of the subject latch mechanism via at least one of the interior door-release handle 22 and exterior door-release handle 26 associated with the respective door. The second state 32 of the latch mechanism 28, on the other hand, facilitates entry to and exit from the vehicle 10 by enabling operation of the subject latch mechanism via the interior door-release handle 22 and exterior door-release handle 26 associated with the respective door.

Figure 3:
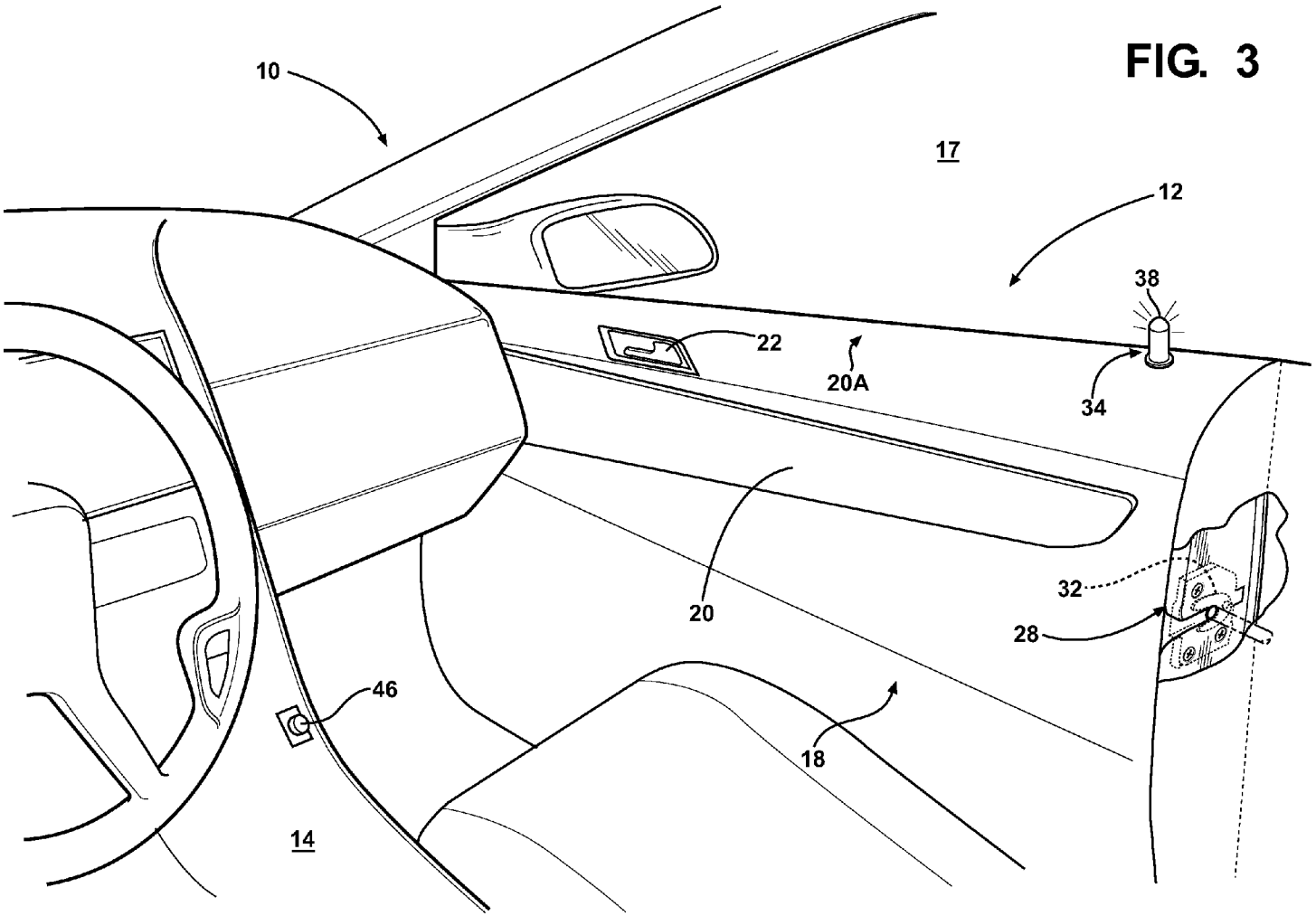
FIG. 3 is a schematic partial perspective view of the vehicle interior shown in FIG. 1, wherein the door is in an unlocked state.

As shown in FIGS. 2-3, the door locking system 18 also includes at least one control switch 34. As shown, each door 16 may include the subject control switch 34. Each control switch 34 is arranged on the vehicle interior-facing surface 20 of a particular door 16 and is configured to generate a command signal 36 for alternate selection of the first and second states 30, 32 of the respective latch mechanism 28, i.e., change the state of the latch mechanism between locked and unlocked. An indicator light 38 is integrally mounted on each control switch 34. The indicator light 38 is configured to provide a visual signal indicative of at least one of the first state 30 and the second state 32 of the respective latch mechanism 28. The indicator light 38 may be configured as a light emitting diode (LED). The LED may be turned "on" to indicate the first state 30 and turned "off" to indicate the alternate second state 32. Alternatively, the LED may be configured to emit light having a first color when the latch mechanism 28 is in the first state 30 and light having a second color when the latch mechanism is in the second state 32, i.e., the LED color for the first state 30 would be different from the color used for the second state 32.

As shown in FIG. 1, a controller 40 is arranged on the vehicle body 12 relative to the vehicle interior 14. The controller 40 may be a vehicle body controller configured to regulate various vehicle systems and functions, such as a Heating Ventilation, and Air Conditioning (HVAC) system, infotainment, and vehicle interior and exterior lighting, or a stand-alone control unit. In either configuration, the controller 40 includes a processor and tangible, non-transitory memory which includes instructions for the door locking system 18 programmed therein. As such, the processor is configured to execute the instructions from memory in the controller 40 to regulate a subject vehicle system or function, including the operation of the door locking system 18.

As shown in FIG. 1, the controller 40 is in operative communication with each latch mechanism 28 and each control switch 34. Additionally, the controller 40 is configured, i.e., programmed, to command each latch mechanism 28 to attain one of the first and second states 30, 32 in response to the signal 36 from the respective control switch 34. Furthermore, the controller 40 is configured to trigger the respective indicator light 38 when the corresponding latch mechanism 28 has attained one of the first and second states 30, 32. Accordingly, the door locking system 18 also includes at least a portion of the controller 40 that is responsible for regulating operation of the latch mechanisms 28.

The controller 40 may be configured to execute a first mode 42 of operation for the door locking system 18 that regulates the latch mechanism 28 of each door 16 to attain one of the first and second states 30, 32 in response to the signal 36 from the respective control switch 34. In the first mode 42, the controller 40 also triggers each respective indicator light 38 when the corresponding latch mechanism 28 has attained one of the first and second states 30, 32. The controller 40 may also be configured to execute an alternative second mode 44 of operation for the door locking system 18 that regulates the latch mechanism 28 of each door 16 to attain one of the first and second states 30, 32 in response to the signal from one of the control switches 34. In the second mode 44, the controller also triggers each respective indicator light 38 when the corresponding latch mechanism 28 has attained one of the first and second states 30, 32. Additionally, the controller 40 may include an interface portal 46 configured to provide access to the user of the vehicle 10 for selecting one of the first and second modes 42, 44. Accordingly, a physical connection to the interface portal 46 may be arranged on the vehicle interior 14, as shown in FIG. 1.

The vehicle 10 may also include a sensor 52 configured to detect a road speed of the vehicle and communicate a signal indicative of such speed to the controller 40. The controller 40 may also have programmed therein a key-on mode 48 for the vehicle 10, where electrically powered vehicle systems, such as HVAC and infotainment may be turned on, are on, and also a key-off mode 50, when such systems are powered off. The controller 40 may also be programmed to execute a third mode 54 of operation for the door locking system 18. The third mode 54 of operation for the door locking system 18 regulates the latch mechanism 28 of each door 16 to attain the first state 30 in response to the vehicle being in the key-on mode 48 and the vehicle 10 exceeding a predetermined road speed as detected by the sensor 52. The third mode 54 of operation for the door locking system 18 also regulates the latch mechanism 28 of each door 16 to attain the second state 32 in response to the vehicle 10 being in the key-off mode 50. The interface portal 46 may be configured to provide access to the user of the vehicle 10 for selecting the third mode 54.

Additionally, the controller 40 may be programmed to execute a fourth mode 55 of operation for the door locking system 18. The fourth mode 55 of operation for the door locking system 18 regulates the latch mechanism 28 of each door 16 to attain the first state 30 in response to the vehicle 10 being in a non-parked state. The vehicle 10 being in a non-parked state may be determined by a transmission of the vehicle, which is not shown but known to those skilled in the art, being in a "drive" mode (such as when the transmission is in any of its forward or reverse gears) as an appropriate indicator of the vehicle state. A parked state of the vehicle 10 via its transmission may be identified and communicated to the controller 40 by a sensor typically configured to detect operating states or modes of the transmission. The fourth mode 55 of operation for the door locking system 18 also regulates the latch mechanism 28 of each door 16 to attain the second state 32 in response to the vehicle 10 being in the parked state via vehicle transmission being in "park" mode. The interface portal 46 may be configured to provide access to the user of the vehicle 10 for selecting the fourth mode 55.

A parked state of the vehicle 10 may also be identified via an engagement state of the vehicle's parking brake (not shown, but known to those skilled in the art) and communicated to the controller 40 by a sensor typically configured to detect the engagement state of such a parking brake. In other words, when the vehicle's parking brake is not engaged, either as a sole indicator or in combination with other indicator(s) of the vehicle state, the fourth mode 55 of operation for the door locking system 18 may regulate the latch mechanism 28 of each door 16 to attain the first state 30. Similarly, when the vehicle's parking brake is engaged, the fourth mode 55 of operation for the door locking system 18 may regulate the latch mechanism 28 of each door 16 to attain the second state 32.

As may be seen form FIGS. 2-3, the vehicle interior-facing surface 20 includes a window sill 20A arranged proximate to the window 17. As additionally shown, the control switch 34 may be positioned on the window sill 20A. The control switch 34 may be configured as a maintained contact switch. A "maintained" contact switch is a switch that physically keeps the button and an electrical circuit in the actuated position, open or closed. A maintained contact switch is configured to selectively open or close an electrical circuit, and then stays in the ON or OFF position until actuated again. The maintained contact type of control switch 34 may be constructed as a lock knob that is configured to be selectively pulled and pushed to alternatively select the first and the second states 30, 32 of the latch mechanism 28.

The control switch 34 may also be configured as an "alternate action" contact switch. An alternate action contact switch keeps the electrical circuit in the actuated position even after the button returns to its normal, i.e., idle, position. Pressing the button of an alternate action contact switch again causes the actuated contact to release and the button to again return to its normal position. The alternate action contact type of control switch 34 may be constructed as a push button that is configured to be pushed to alternatively select the first and the second states 30, 32 of the latch mechanism 28.

The indicator light 38 may additionally be configured to respond to door lock/unlock commands generated by other sensors and/or switches, not just to the command signal 36 generated by the corresponding control switch 34. As understood by those skilled in the art, other lock/unlock commands may come from, but not limited to, conventional power door lock switches, any switches mounted on the outside of the vehicle that control the lock state of the respective latch mechanisms 28, door ajar/open switches which unlock a door when it is opened, a control switch 34 from another door, and either actively or passively from remote key fobs.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment can be combined with one or a plurality of other desired characteristics from other embodiments, resulting in other embodiments not described in words or by reference to the drawings. Accordingly, such other embodiments fall within the framework of the scope of the appended claims.

The invention claimed is:

1. A door system for a vehicle having a vehicle body and a body controller, the door comprising:
- a vehicle interior-facing surface; and
- a door locking system having:
  - a latch mechanism for selectively latching the door to and unlatching the door from the vehicle body and configured to alternatively attain a first state and a second state, wherein the first state locks and the second state unlocks operation of the latch mechanism;
  - a door-release handle positioned on the vehicle interior-facing surface and configured to release the latch mechanism;
  - a control switch arranged on the vehicle interior-facing surface and configured to generate a signal for alternate selection of the first and second states of the latch mechanism; and
  - an indicator light integrally mounted on the control switch and configured to provide a visual signal indicative of at least one of the first and second states of the latch mechanism;
  - wherein:
    - each of the latch mechanism and the control switch is in operative communication with the body controller; and
    - the body controller is configured to receive the signal from the control switch, command the latch mechanism to attain one of the first and second states in response to the signal, and trigger the indicator light when the latch mechanism has attained one of the first and second states.

2. The door system of claim 1, wherein:
- the door includes a window;
- the vehicle interior-facing surface includes a window sill arranged proximate to the window; and
- the control switch is positioned on the window sill.

3. The door system of claim 1, wherein the control switch is configured as a maintained contact switch.

4. The door system of claim 1, wherein the control switch is a lock knob that is configured to be selectively pulled and pushed to alternatively select the first and the second states of the latch mechanism.

5. The door system of claim 1, wherein the indicator light is configured as a light emitting diode (LED).

6. The door system of claim 5, wherein the LED is configured to emit light having a first color when the latch mechanism is in the first state and light having a second color when the latch mechanism is in the second state.

7. A vehicle comprising:
- a vehicle body defining an entryway into a vehicle interior;

a door having a vehicle interior-facing surface and configured to selectively open and close the entryway; and a door locking system having:

a controller arranged on the vehicle body;

a latch mechanism for selectively latching the door to and unlatching the door from the vehicle body and configured to alternatively attain a first state and a second state, wherein the first state locks and the second state unlocks operation of the latch mechanism;

a door-release handle positioned on the vehicle interior-facing surface and configured to release the latch mechanism;

a control switch arranged on the vehicle interior-facing surface and configured to generate a signal for alternate selection of the first and second states of the latch mechanism; and an indicator light integrally mounted on the control switch and configured to provide a visual signal indicative of at least one of the first and second states of the latch mechanism;

wherein:

each of the latch mechanism and the control switch is in operative communication with the controller; and the controller is configured to receive the signal from the control switch, command the latch mechanism to attain one of the first and second states in response to the signal, and trigger the indicator light when the latch mechanism has attained one of the first and second states.

8. The vehicle of claim 7, wherein:

the door includes a window;

the vehicle interior-facing surface includes a window sill arranged proximate to the window; and the control switch is positioned on the window sill.

9. The vehicle of claim 7, wherein the door is a plurality of doors, and wherein the controller includes an algorithm configured to regulate selection of the first and the second states of each latch mechanism on the respective door in response to the signal from the respective control switch.

10. The vehicle of claim 9, wherein the controller is configured to execute:

a first mode of operation for the door locking system that regulates the latch mechanism of each door to attain one of the first and second states in response to the signal from the respective control switch, and trigger each respective indicator light when the corresponding latch mechanism has attained one of the first and second states; and a second mode of operation for the door locking system that regulates the latch mechanism of each door to attain one of the first and second states in response to the signal from one of the control switches, and trigger each respective indicator light when the corresponding latch mechanism has attained one of the first and second states.

11. The vehicle of claim 10, wherein the controller includes an interface portal configured to provide access to the user for selecting one of the first and second modes.

12. The vehicle of claim 11, wherein:

the vehicle has a key-on mode and a key-off mode;

the controller is configured to execute a third mode of operation for the door locking system that regulates the latch mechanism of each door to attain the first state in response to the vehicle being in the key-on mode and exceeding a predetermined vehicle speed and regulates the latch mechanism of each door to attain the second state in response to the vehicle being in the key-off mode; and the interface portal is configured to provide access to the user for selecting the third mode.

13. The vehicle of claim 12, wherein the indicator light is configured as a light emitting diode (LED).

14. The vehicle of claim 13, wherein the interface portal is configured to provide access to the user for selecting a color of light emitted by the LED.

15. The vehicle of claim 14, wherein the color of light emitted by the LED is a first color when the latch mechanism is in the first state and a second color when the latch mechanism is in the second state.

16. The vehicle of claim 7, wherein the control switch is configured as a maintained contact switch.

17. The vehicle of claim 7, wherein the control switch is a lock knob that is configured to be selectively pulled and pushed to alternatively select the first and the second states of the latch mechanism.

18. A door locking system for a vehicle having a vehicle body defining a vehicle interior and a plurality of doors each having a vehicle interior-facing surface, wherein each of the doors is configured to selectively open and close an entryway into the vehicle interior, the door locking system comprising:

a vehicle body controller arranged on the vehicle body;

a latch mechanism arranged on each of the plurality of doors for selectively latching the door to and unlatching the door from the vehicle body and configured to alternatively attain a first state and a second state, wherein the first state locks and the second state unlocks operation of the subject latch mechanism;

a door-release handle positioned on the vehicle interior-facing surface and configured to release the latch mechanism;

a control switch arranged on the vehicle interior-facing surface of each of the plurality of doors and configured to generate a signal for alternate selection of the first and second states of the respective latch mechanism; and an indicator light integrally mounted on each control switch and configured to provide a visual signal indicative of at least one of the first and second states of the respective latch mechanism;

wherein:

each of the latch mechanism and the control switch is in operative communication with the vehicle body controller; and the vehicle body controller is configured to receive the signal from the control switch, command the latch mechanism to attain one of the first and second states in response to the signal, and trigger the indicator light when the latch mechanism has attained one of the first and second states.

19. The system of claim 18, wherein the vehicle body controller is configured to execute:

a first mode of operation for the door locking system that regulates the latch mechanism of each door to attain one of the first and second states in response to the signal from the respective control switch, and trigger each respective indicator light when the corresponding latch mechanism has attained one of the first and second states; and a second mode of operation for the door locking system that regulates the latch mechanism of each door to attain one of the first and second states in response to the signal from one of the control switches, and trigger each respective indicator light when the corresponding latch mechanism has attained one of the first and second states.

20. The vehicle of claim 19, wherein the vehicle body controller includes an interface portal configured to provide access to the user for selecting one of the first and second modes.

* * * * *